US007438848B2

(12) United States Patent
Strelbisky et al.

(10) Patent No.: US 7,438,848 B2
(45) Date of Patent: Oct. 21, 2008

(54) METALLURGICAL LANCE

(75) Inventors: Michael James Strelbisky, Burlington (CA); Andrew Peter Richardson, Clinton, NJ (US); Mark Alan Wilkinson, Lincoln, MA (US)

(73) Assignee: The BOC Group, Inc., Murray Hill, NJ (US)

( * ) Notice: Subject to any disclaimer, the term of this patent is extended or adjusted under 35 U.S.C. 154(b) by 738 days.

(21) Appl. No.: 10/881,489

(22) Filed: Jun. 30, 2004

(65) Prior Publication Data

US 2006/0001201 A1 Jan. 5, 2006

(51) Int. Cl.
*C21C 7/00* (2006.01)

(52) U.S. Cl. ..... 266/225

(58) Field of Classification Search ..... 266/225
See application file for complete search history.

(56) References Cited

U.S. PATENT DOCUMENTS 4,666,187 A * 5/1987 Koot ..... 285/24
5,370,309 A 12/1994 Strelbisky et al.
5,814,125 A 9/1998 Anderson et al.
5,823,762 A 10/1998 Anderson et al.
6,096,261 A 8/2000 Anderson et al.
6,125,133 A 9/2000 Mathur et al.
6,139,310 A 10/2000 Mahoney et al.
6,142,764 A 11/2000 Anderson et al.
6,171,544 B1 1/2001 Anderson et al.
6,176,894 B1 1/2001 Anderson et al.
6,241,510 B1 6/2001 Anderson et al.
6,261,338 B1 7/2001 Mahoney et al.
6,334,976 B1 1/2002 Anderson et al.
6,400,747 B1 6/2002 Mathur
6,432,163 B1 8/2002 Sarma et al.
6,450,799 B1 9/2002 Mahoney et al.
6,604,937 B1 8/2003 Mahoney
6,709,630 B2 3/2004 Cameron et al.
2003/0075843 A1 * 4/2003 Wunsche ..... 266/225

* cited by examiner

*Primary Examiner*—Scott Kastler
(74) *Attorney, Agent, or Firm*—Joshua L. Cohen

(57) ABSTRACT

A metallurgical lance for introducing gas into a volume of molten material in a furnace includes a head having a bore extending therethrough, a mounting assembly at the head in the bore, and a nozzle detachably secured to the mounting assembly by a connection, the nozzle adapted to coact with a tool releasably engagable with the nozzle to insert and withdraw same from the lance head through the bore without dismantling the nozzle.

17 Claims, 7 Drawing Sheets

METALLURGICAL LANCE

FIELD OF INVENTION

This invention relates to metallurgical lances for introducing gas into a volume of metal in a vessel.

BACKGROUND OF INVENTION

Metallurgical lances having a head with at least one gas ejector therein are know. See for example, U.S. Pat. No. 6,709,630 to Cameron et al. which issued Mar. 23, 2004, and which is hereby incorporated herein by reference. The ejector disclosed in Cameron et al. has a nozzle surrounded by a shrouding gas passage. In practice, because of routine wear and tear, it is necessary to replace the nozzle from time to time. This is accomplished by removing the lance from the vessel and then removing the nozzle from the lance which can only be achieved by cutting the lance head from the lance for access to an interior upper end thereof, as can be seen for example from the drawings of the above mentioned patent. This is time consuming, awkward to effect and may compromise the structural integrity of the lance head.

SUMMARY OF INVENTION

According to the invention, the nozzle is removably mounted in the lance head in such a manner that removal of the nozzle from the head can be effected by use of a tool adapted to engage and remove the nozzle from below the head without dismantling or cutting the lance to effect nozzle replacement. The nozzle may have screw-threaded engagement with the head or may be connected thereto by a bayonet connection.

It is therefore an object of this invention to provide a metallurgical lance with a nozzle adapted to be replaced by a tool in a less time consuming and less damaging manner.

Accordingly, there is provided herein:

A metallurgical lance for introducing gas from a volume of molten material in a vessel, comprising a head having a bore extending through the head from a proximal end to a distal end thereof, a mounting assembly at the head adjacent the proximal end of the bore, and a nozzle located in the bore and detachably secured to the mounting assembly by a connection which enables detachment of the nozzle from the mounting assembly to be effected by a tool engageable with the nozzle by movement of the tool from outside of the head, whereby the nozzle can then be withdrawn from the bore through the distal end of the head.

A head for a metallurgical lance, comprising a bore extending through the head from a proximal end to a distal end thereof, a mounting assembly at the head adjacent the proximal end of the bore, and a nozzle located in the bore and detachably secured to the mounting assembly by a connection which enables detachment of the nozzle from the mounting assembly to be effected by a tool engageable with the nozzle by movement of the tool from outside of the head, whereby the nozzle can then be withdrawn from the bore through the distal end of the head.

A method of removing a nozzle from a metallurgical lance, wherein the metallurgical lance includes a head having a bore extending through the head from a proximal end to a distal end thereof, a mounting assembly at the head adjacent the proximal end of the bore, and a nozzle located in the bore and detachably secured to the mounting assembly, the method comprising engaging the nozzle with a tool by movement of the tool from outside of the head, operating the tool to effect detachment of the nozzle from the mounting assembly and removing the detached nozzle from the bore through the distal end of the head.

A head for a lance, comprising a body portion having a proximal end for connection to the lance, and a distal end disposed away from the proximal end; and a nozzle supported in the body portion and adapted to be removably mounted therewith through the distal end of the body portion.

A method of removing a nozzle from a gas ejector of a lance head, comprising releasably engaging the nozzle with a tool at the gas ejector, displacing the position of the nozzle in the gas ejector with the tool, and removing the nozzle form the lance head through the gas ejector with the tool.

In a method of disposing a nozzle in a lance, wherein the lance is of the type having a proximal end, and a distal end opposed to the proximal end and at which gas is ejected, the improvement comprising removably mounting the nozzle to the lance from the distal end with a tool operable to displace the nozzle for selective mounting and removal from said lance.

A tool for selectively mounting and a removing a nozzle with respect to an ejector discharge end of a lance, comprising a body portion, engaging means disposed at the body portion for releasably engaging a select region of the nozzle for displacement of the nozzle from the ejector discharge end, wherein the body portion is movable to actuate the engaging means into a select position with respect to the nozzle.

DESCRIPTION OF THE DRAWINGS

Embodiments of the invention will now be described, by way of example, with reference to the accompanying drawings, of which.

DESCRIPTION OF THE INVENTION

Figure 1:
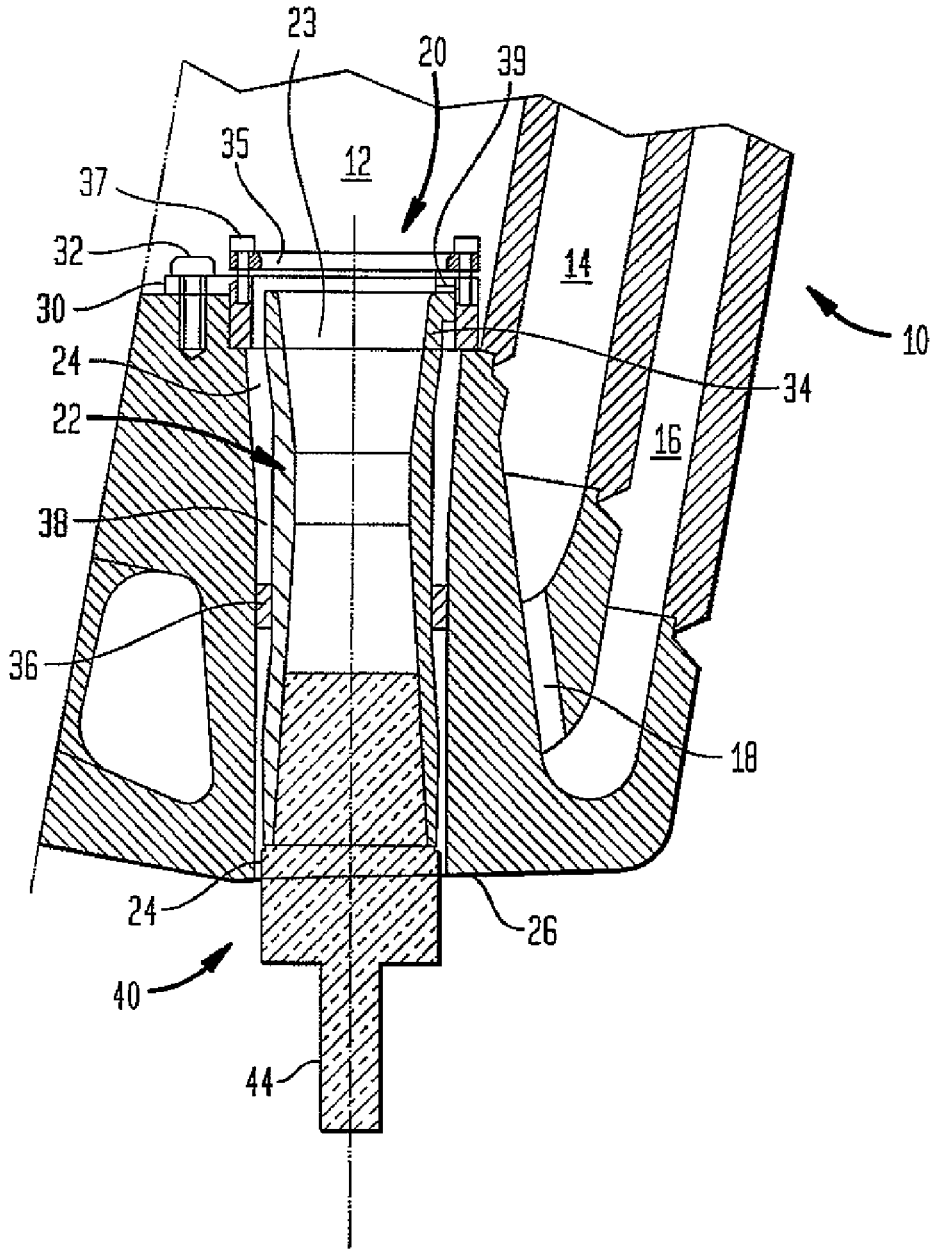
FIG. 1 is a sectional side view of part of a head of a metallurgical lance showing an ejector in which the nozzle is secured in the head by means of a bayonet connection, a nozzle removal tool also being shown.

Referring to the Figures, FIG. 1 shows part of a head 10 of a metallurgical lance, a gas supply chamber 12 with annular passages for cooling fluid, therebeing an inner inlet passage 14 and an outer outlet passage 16 connected by a connecting chamber or passage 18. The head 10 includes an ejector shown generally at 20, which includes a nozzle 22 removably mounted in a bore 24 at a tip 26 of the head 10. A distal or bottom end of the nozzle 22 is set back or recessed from a lower or distal end of the bore 24. The nozzle 22 includes a passageway 23 extending therethrough.

Figure 2:
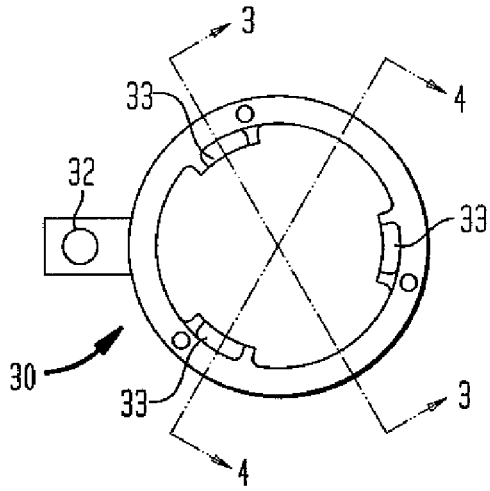
FIG. 2 is a sectional elevation view of a mounting ring forming part of the head shown in FIG. 1.
Figure 3:
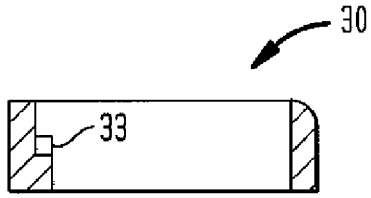
FIG. 3 is a cross-section view through the line A-A in FIG. 2.
Figure 4:
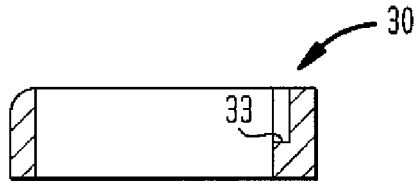
FIG. 4 is a cross-section view through the line B-B in FIG. 2.

Referring also to the FIGS. 2-4, the nozzle 22 is held in place by a bayonet connection at its upper or proximal end. A mounting assembly including a mounting bracket or ring 30 is secured to the head 10 at the upper or proximal end of the bore 24 by mechanical fasteners such as screws 32, and the nozzle 22 has a plurality of equi-angularly spaced outwardly projecting lugs 34 at its upper end which releasably engage complementary shoulders 33 integral with the mounting ring 30 in such a manner as to form a bayonet connection.

Figure 5:
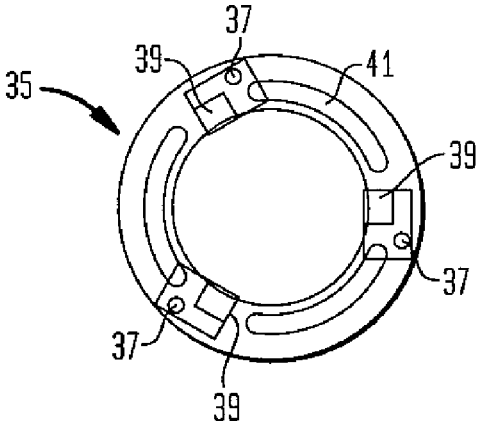
FIG. 5 is a view from below of a retaining ring forming part of the head shown in FIG. 1.
Figure 6:
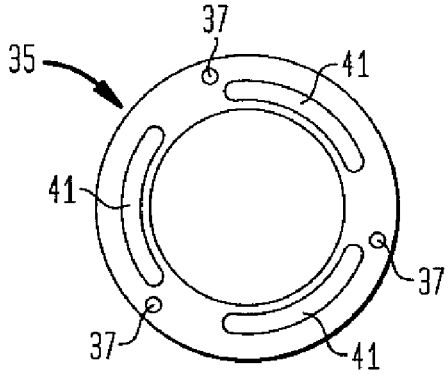
FIG. 6 is a plan view of the retaining ring shown in FIG. 5.

A retaining ring 35 prevents excessive inward displacement of the nozzle 22 into the head 10. The retaining ring 35 is adjustably held in position on the mounting ring 30 by fasteners such as set screws 37. As shown in FIG. 5, a surface of the retaining ring 35 is provided with a plurality of equally spaced biasing members such as spring plates 39, which is shown in FIG. 1. Each of the spring plates 39 bear against the lugs 34 of the nozzle 22. The spring plates 39 help to retain the nozzle 22 in its demountably coupled position. As shown in FIGS. 5 and 6, the retaining ring 35 is formed with a plurality of equally spaced slot-like apertures 41 that permit gas to flow from the chamber 12 through an annular passage 38 which exists between the bore 24 and the nozzle 22.

The nozzle 22 also has external lugs 36 disposed at an exterior of the nozzle approximately midway along said nozzle's length. The lugs 36 contact the wall of the head at the bore 24 as shown in FIG. 1.

Figure 7:
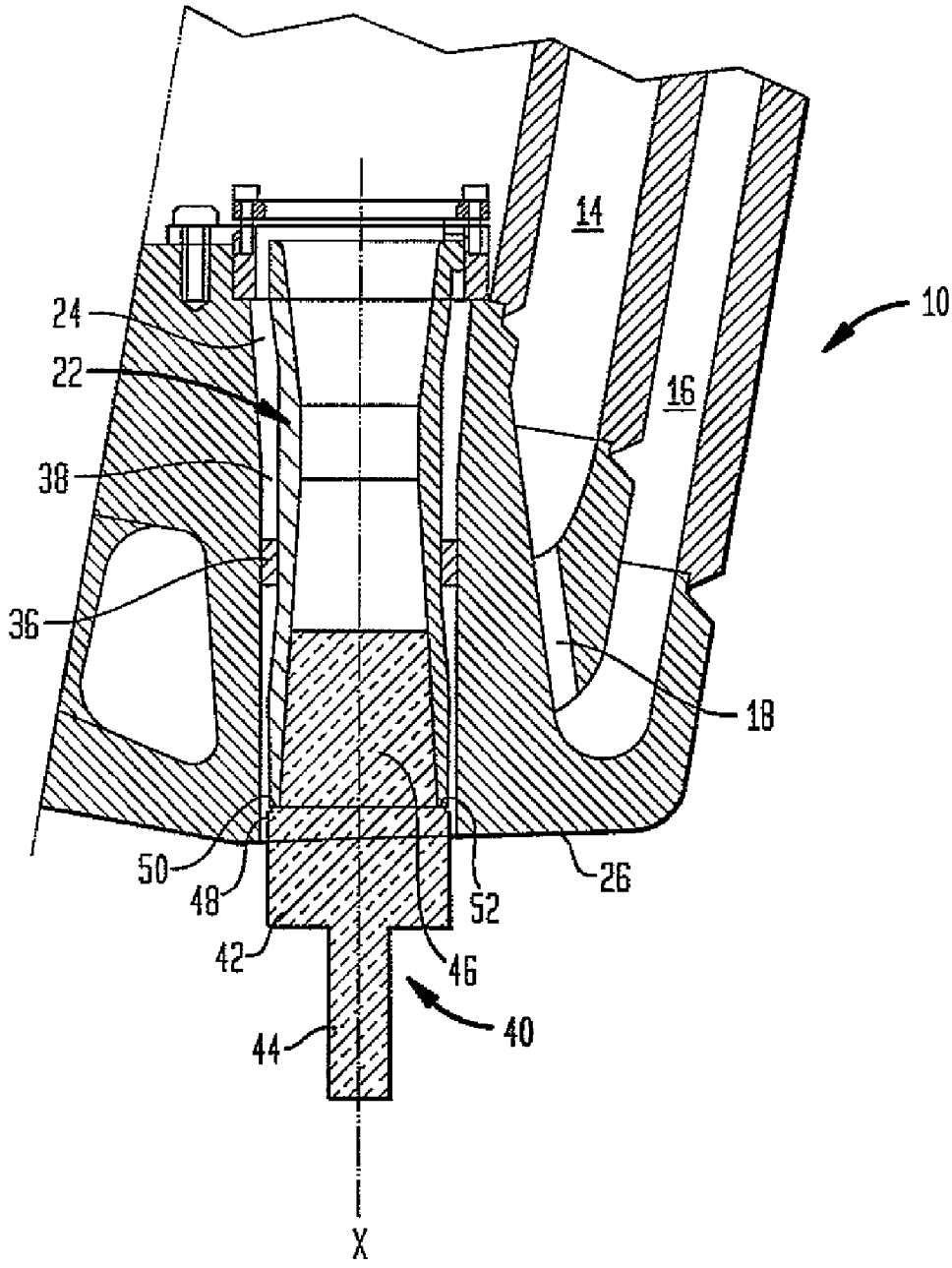
FIG. 7 is an enlarged view of part of FIG. 1 showing how the removal tool engages the nozzle.

Referring to FIG. 7, a tool 40 is provided of a construction to both remove and mount the nozzle 22 with respect to the bore 24. The tool 40 includes a main body 42 with a shaft 44 extending from one end and a tapered portion 46 extending from the other end of the body 42. An annular ledge 48 extends around the end of the main body 42 adjacent the forward portion 46, and the ledge 48 has a series of pins 50 extending from the ledge 48 toward the forward portion 46. A lower edge of the nozzle 22 has recesses 52 constructed and arranged to receive corresponding ones of the pins 50.

When it is desired to remove the nozzle 22, the tool 40 is engaged with the lower or distal end portion of the nozzle 22 as shown in FIG. 7, with the tapered portion 46 inserted into the nozzle 22 for the pins 50 to be in registration with and engage respective ones of the recesses 52. The tool 40 is then rotated about its longitudinal axis as shown generally at "X" by means of a rotational force applied to the shaft 44 so as to uncouple the lugs 34 on the nozzle 22 from the shoulders 33 on the mounting ring 30. It will then be possible to withdraw the nozzle 22 from the lower or distal end of the bore 24. A new nozzle can then be disposed in the bore 24 to be removably mountable with the head 10 in a reverse manner.

The operation of the lance shown in FIGS. 1-7 is similar to the operation of the lances disclosed in U.S. Pat. No. 6,709,360, said patent incorporated herein by reference. Gas, typically oxygen, is supplied under pressure to the chamber or passage 12. Most of the gas passes directly through the passageway 23 to the nozzle 22. Some of the gas, however, flows through the annular passage 38 between the wall at the bore 24 and the nozzle 22. The discharge end of annular passage 38 has an appropriate convergence and/or divergence section 95 so as to effect a perfect expansion of the annular gas stream. The section 95 of the annular passage 38 is preferably created by selected machined profiles for the outer surfaces of the nozzle 22, which are calculated in a manner similar to that employed for the design of a convergent-divergent profile at the interior of the nozzle 22.

During operation in a hot metallurgical environment, the gas flowing from the passage 38 helps to protect the distal end of the nozzle 22 from erosion or other damage attributable to the hot environment. The retracted or recessed position of the distal end of the nozzle 22 relative to the distal end of the bore 24 helps to protect the nozzle 22 from damage by hot gases. The gas ejected from the distal end of the annular passage 38 effectively merges with gas ejected from the passageway 23 through the distal end of the nozzle 22, and the merged gas stream typically passes at high velocity into a volume of molten metal to be treated.

The lance shown in FIGS. 1-7 is operatively associated with a manipulator (not shown) of a kind known in the art. The manipulator is able to lower and raise the lance head 10. When it is desired to replace the nozzle 22 with a new nozzle, the manipulator is operated to raise the lance and hence the head 10. The nozzle 22 may then be removed with the tool 40 being inserted from below as shown in FIG. 1. A new nozzle 22 may then be inserted. If desired, however, the lance may be removed from the manipulator and the nozzle 22 removed and a new nozzle fitted at a location remote from the metallurgical furnace served by the lance. Such may be done with the lance held in any convenient orientation to enable the tool to be inserted and actuated for removal or insertion of the nozzle 22 as the operation may require.

Figure 8:
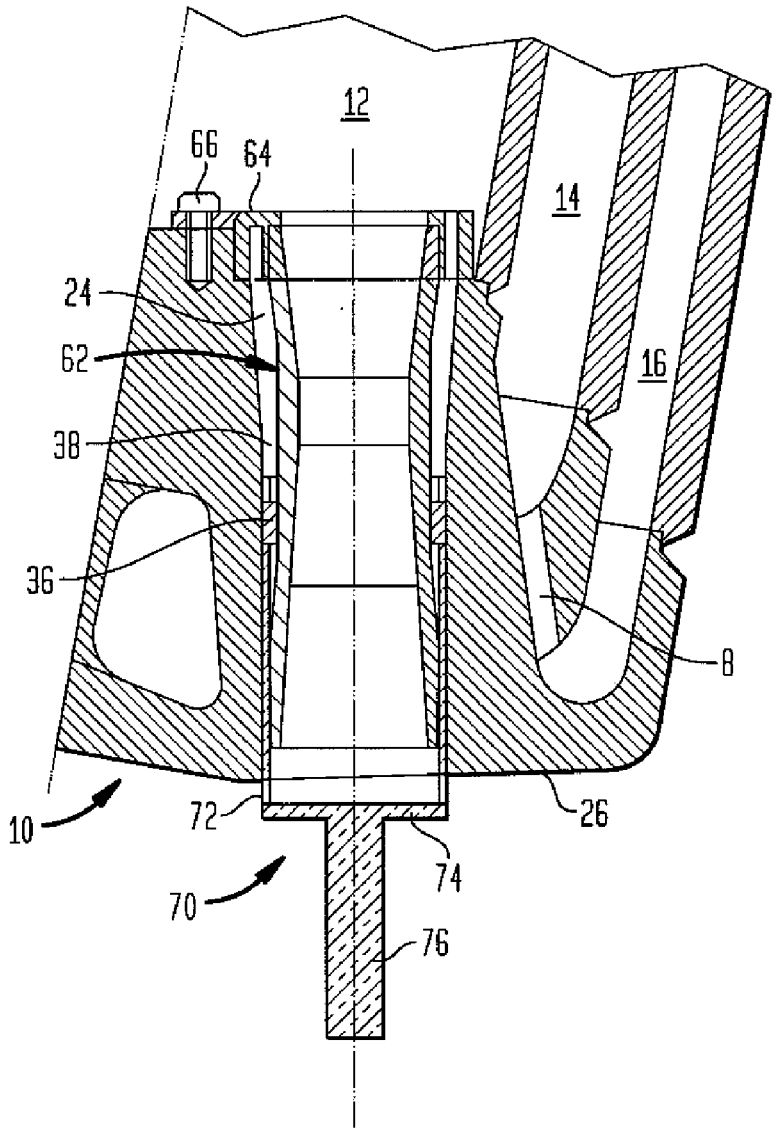
FIG. 8 is a sectional side view of part of the head of a metallurgical lance showing an ejector in which the nozzle is secured in the head by screw-threaded engagement, a nozzle removal tool also being shown.
Figure 9:
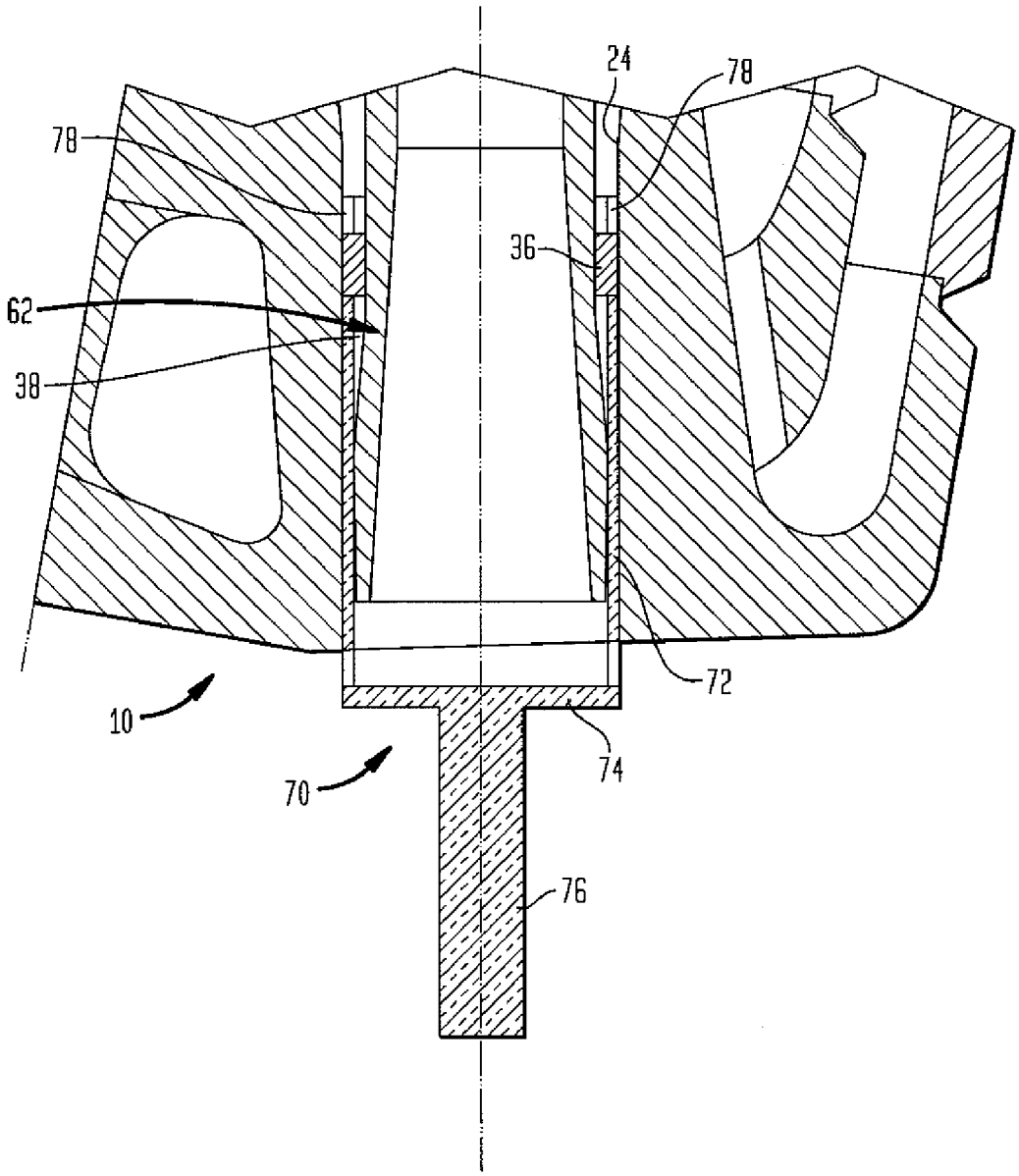
FIG. 9 is an enlarged view of part of FIG. 8 showing how the removable tool engages with the nozzle.
Figure 10:
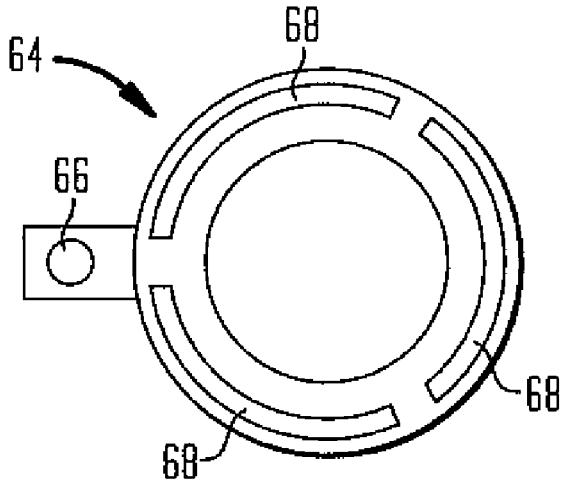
FIG. 10 is a sectional elevation view of a mounting ring forming part of the head shown in FIG. 8.

FIGS. 8 and 9 show another embodiment for mounting a nozzle 62 in the lance head 10. For simplicity, elements in FIGS. 8 and 9 which correspond to elements in FIGS. 1-7 rely on the same reference numerals, unless indicated otherwise. In this embodiment, an outer surface of the nozzle 62 is threaded at its upper end for releasable engagement with a complementary thread formed on an inner surface of a mounting ring or bracket 64 secured to the head 10 by mechanical fasteners such as screws 66. The mounting ring 64 as shown in FIG. 10 is formed with a plurality of equally-spaced passages 68 therethrough to permit gas to flow from the chamber 12 through the annular passage 38 which exists between the bore 24 and the nozzle 62.

Referring to FIG. 9, a tool 70 has a cylindrical open-ended body 72 with a lower end wall 74 from which a handle 76 extends. An end of the cylindrical body 72 remote from the end wall 74 has axially extending slots 78 corresponding in number and circumferential location with the lugs 36 on the nozzle 62. The body 72 has an interior of sufficient size and shape to receive at least a portion of the nozzle 62 therein.

When it is desired to remove the nozzle 62, the tool 70 is engaged with the nozzle 62 by sliding the cylindrical body 72 into the annular passage 38, such that the body 72 is between the nozzle 62 and the wall at the bore 24 in the tip 26 of the lance head 10 until the lugs 36 engage the slots 78. The tool 70 is then rotated to threadably disengage the nozzle 62 from the mounting ring 64 and thus enable the nozzle 62 to be withdrawn from the lower end of the bore 24. Thereafter, a new nozzle can be fitted in a reverse manner.

The tool shown in FIGS. 1-7 may be used with a nozzle having a screw thread connection to the mounting bracket, while the tool shown in FIG. 9 may be used with a nozzle having a bayonet-type connection to the mounting ring 34.

Figure 11:
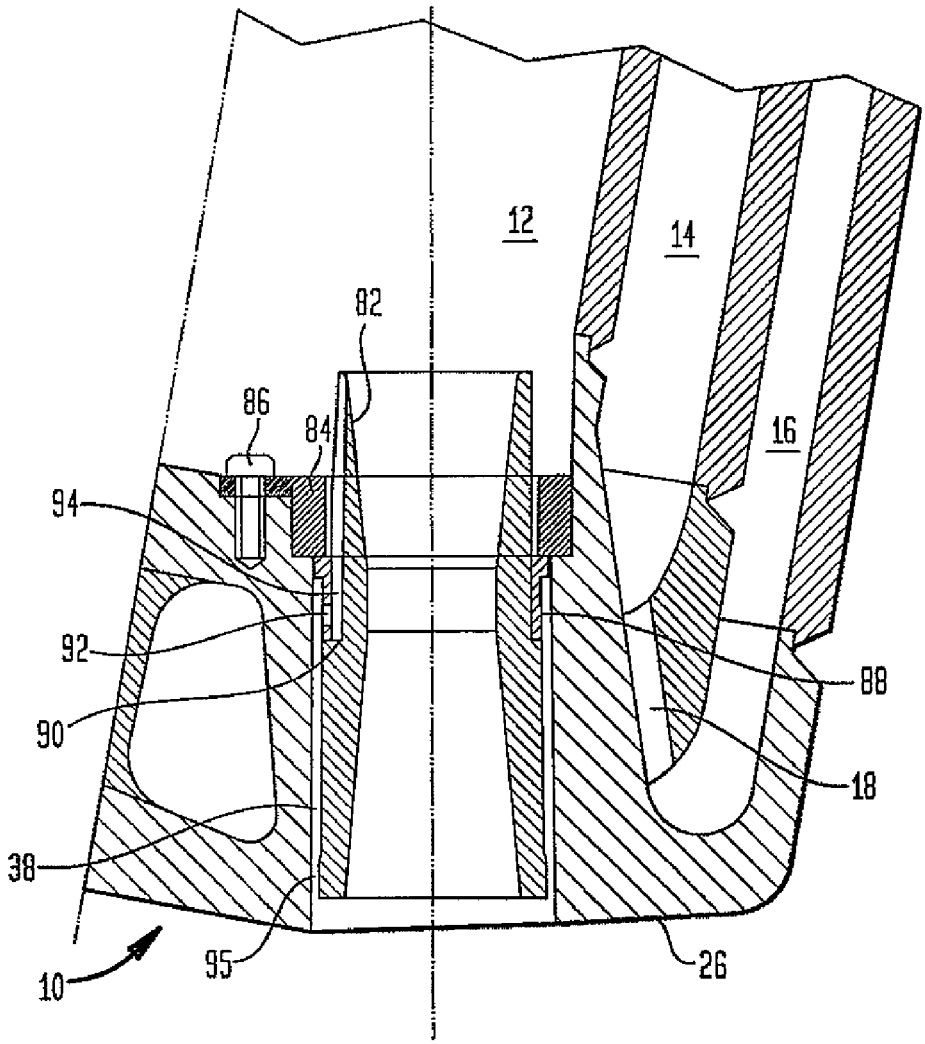
FIG. 11 is a sectional side view of part of the head of a metallurgical lance showing an ejector having a nozzle which is removable from below and which has a metering passage for the shroud gas at the lower end of the nozzle.

FIG. 11 shows a further embodiment in which a metering passage is provided. In this embodiment, a nozzle 82 is screw threaded into engagement with a mounting bracket or ring 84 secured to the inner upper end of the tip 26 by mechanical fasteners such as screws 86, and a spacing collar 88 is located between the mounting bracket 84 and an annular shoulder 90 at an exterior of the nozzle 82. The exterior of the nozzle 82 is screw threaded at the appropriate location to engage with internal screw threads on the mounting bracket 84. The spacing collar 88 can be attached to the nozzle 82 by mechanical fasteners such as screw threads (not shown) or by set screws (not shown). The spacing collar 88 is formed with one or a plurality of metering orifices 92 therethrough. The metering orifices 92 meter the flow of gas from the chamber 12 via axial passages 94 to the annular passage 38. The flow of gas through the annular passage 38 is determined by the number and size of the metering orifices.

A shroud of low Mach velocity can be produced by restricting the gas flow through a series of the metering orifices 92 in the spacing collar 88. The gas is expanded in the annular passage 38 and exits through the converging and/or diverging channel 95. The ability to control the shroud gas facilitates a simple method to change the quantity of, or thrust contributed by, the shroud gas as dictated by the changes to process requirements.

The nozzle 82 can be removed by an arrangement such as described with reference to FIGS. 1 and 8.

It will be understood that the embodiment(s) described herein is/are merely exemplary and that a person skilled in the art may make many variations and modifications without departing form the spirit and scope of the invention. All such modifications are intended to included within the scope of the invention as defined in the appended claims. It should be understood that the embodiments described above are not only in the alternative, but can be combined.

What is claimed is:

1. A metallurgical lance for introducing gas into a volume of molten material in a vessel, comprising: a head having a bore extending through the head from a proximal end to a distal end thereof; a mounting assembly at the head adjacent the proximal end of the bore; and a nozzle located in the bore, the nozzle comprising a connection for detachably connecting the nozzle to the mounting assembly, and engaging means disposed at an exterior of the nozzle for releasably engaging a tool for movement of the nozzle to be selectively inserted or withdrawn from the bore through the distal end of the head.

2. The metallurgical lance according to claim 1, wherein said connection for the nozzle and the mounting assembly is a bayonet connection.

3. The metallurgical lance according to claim 1, wherein said connection for the nozzle and the mounting assembly is a screw-thread connection.

4. The metallurgical lance according to claim 1, wherein the engaging means comprises recesses in a distal end of the nozzle for coaction with the tool.

5. The metallurgical lance according to claim 1, wherein the engaging means comprises outwardly projecting lugs extending from the nozzle for coaction with the tool.

6. The metallurgical lance according to claim 1, further comprising an annular gas passage provided between the nozzle and a wall of the bore.

7. The metallurgical lance according to claim 6, wherein the nozzle further comprises a metering collar having metering orifices therethrough setting a flow rate of gas into the annular gas passage.

8. A head for a metallurgical lance, comprising a bore extending through the head from a proximal end to a distal end thereof; a mounting assembly at the head adjacent the proximal end of the bore; and a nozzle located in the bore, the nozzle comprising a connection for detachably connecting the nozzle to the mounting assembly, and engaging means disposed at an exterior of the nozzle for releasably engaging a tool for movement of the nozzle to be selectively inserted or withdrawn from the bore through the distal end of the head.

9. The head according to claim 8, wherein said connection for the nozzle and the mounting assembly is a bayonet connection.

10. The head according to claim 8, wherein said connection for the nozzle and the mounting assembly is a screw-thread connection.

11. The head according to claim 8, wherein the engaging means comprises recesses in a distal end of the nozzle for coaction with the tool.

12. The head according to claim 8, wherein the engaging means comprises outwardly projecting lugs extending from the nozzle for coaction with the tool.

13. The head according to claim 8, further comprising an annular gas passage provided between the nozzle and a wall of the bore.

14. The head according to claim 13, wherein the nozzle further comprises a metering collar having metering orifices therethrough setting a flow rate of gas into the annular gas passage.

15. A head for a lance, comprising:

a body portion comprising a proximal end for connection to the lance, and a distal end disposed away from the proximal end;

a nozzle supported in the body portion and having first engaging means sized and shaped to removably mount the nozzle through the distal end of the body portion; and a tool having second engaging means sized and shaped to coact with the first engaging means of the nozzle to removably mount the nozzle through the distal end of the body portion.

16. The head according to claim 15, wherein the nozzle comprises an interior surface constructed and arranged to releasably engage the tool.

17. The head according to claim 15, wherein the nozzle comprises an exterior surface constructed and arranged to releasably engage the tool.

* * * * *